United States Patent [19]

Yoshizawa et al.

[11] Patent Number: 4,673,846

[45] Date of Patent: Jun. 16, 1987

[54] MICROWAVE DISCHARGE LIGHT SOURCE APPARATUS

[75] Inventors: Kenji Yoshizawa, Takrazuka; Hirotsugu Komura, Nagasaki; Hitoshi Kodama, Yokosuka; Kazushi Ohnuki, Hiratsuka; Isao Shoda, Yokohama; Kazuo Magome, Kamakura; Hiroshi Ito, Yokohama, all of Japan

[73] Assignee: Mitsubishi Denki Kabushiki Kaisha, Tokyo, Japan

[21] Appl. No.: 705,529

[22] Filed: Feb. 26, 1985

[30] Foreign Application Priority Data

| | | | |
|---|---|---|---|
| Mar. 2, 1984 | [JP] | Japan | 59-39980 |
| May 7, 1984 | [JP] | Japan | 59-90343 |
| May 7, 1984 | [JP] | Japan | 59-90345 |
| May 7, 1984 | [JP] | Japan | 59-90346 |
| May 7, 1984 | [JP] | Japan | 59-66298[U] |
| May 7, 1984 | [JP] | Japan | 59-66299[U] |
| May 7, 1984 | [JP] | Japan | 59-66300[U] |
| May 8, 1984 | [JP] | Japan | 59-91369 |
| Jun. 8, 1984 | [JP] | Japan | 59-85101[U] |
| Aug. 9, 1984 | [JP] | Japan | 59-122110[U] |
| Oct. 19, 1984 | [JP] | Japan | 59-219926 |

[51] Int. Cl.[4] ..... H05B 41/16; H05B 41/24

[52] U.S. Cl. ..... 315/248; 315/39; 315/111.21; 315/344

[58] Field of Search ..... 315/39, 111.21, 111.31, 315/248, 344

[56] References Cited

U.S. PATENT DOCUMENTS

| | | | |
|---|---|---|---|
| 3,374,393 | 3/1968 | Bramley | 315/39 |
| 3,541,372 | 11/1970 | Omura et al. | 315/39 X |
| 3,609,448 | 9/1971 | Williams | 315/39 |
| 3,641,389 | 2/1972 | Leidigh | 315/39 |
| 3,814,983 | 6/1974 | Weissfloch et al. | 315/39 |
| 3,872,349 | 3/1975 | Spero et al. | 315/39 |
| 3,911,318 | 10/1975 | Spero et al. | 315/39 |
| 4,498,029 | 2/1985 | Yoshizawa et al. | 315/39 |
| 4,507,587 | 3/1985 | Wood et al. | 315/39 |

FOREIGN PATENT DOCUMENTS 3323637 5/1984 Fed. Rep. of Germany .

OTHER PUBLICATIONS

Patents Abstracts of Japan, vol. 8, No. 36 (E227)[1473], 16th Feb. 1984; & JP-A No. 58 194 242 (Mitsubishi Denki K.K.) 12-11-1983.

*Primary Examiner*—Saxfield Chatmon

*Attorney, Agent, or Firm*—Oblon, Fisher, Spivak, McClelland & Maier

[57] ABSTRACT

In a microwave discharge light source apparatus for effecting discharge of an electrodeless discharge lamp held in a cavity which causes resonance by microwaves, the wall surface of the cavity resonator is constituted by a mesh and wires constituting the mesh, are electrically connected at each crossing point without resistance of contact. Effective discharging of the lamp is attainable and the cavity has a mechanically strengthened structure.

49 Claims, 38 Drawing Figures

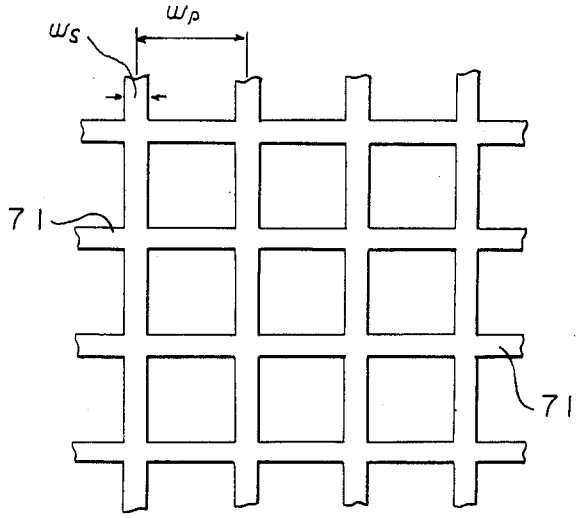
FIGURE 4
FIGURE 5
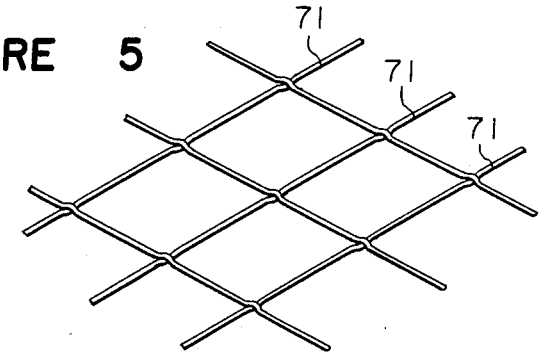
FIGURE 6
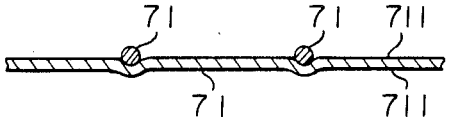

MICROWAVE DISCHARGE LIGHT SOURCE APPARATUS

The present invention relates to a microwave discharge light source apparatus having an electrodeless discharge lamp (hereinbelow referred simply to as a lamp) in a microwave resonance cavity provided with a wall surface, a substantial part of which is constituted by a light transmitting member, wherein electric discharge is caused in the lamp to emit light by energy of the microwaves.

A microwave discharge light source apparatus having a microwave resonance cavity having a cavity wall surface, a substantial part of which is constituted by a light transmitting member is known in publications such as Japanese Unexamined Utility Model Publication No. 168167/1982 (FIG. 1).

The conventional apparatus as shown in FIG. 1 is constructed in such a manner that microwaves radiated from a magnetron 1 are passed from a magnetron antenna 2 through a waveguide 3 and are fed into a microwave resonance cavity 5 through a power feeding port 8. Electric discharge of gas is caused in a lamp 9 by the microwaves. Light caused by luminescence of the gas is emitted outside through a metallic mesh 7. The emitted light is reflected by a light refleting plate (not shown) and so on to shine a surface to be irradiated. In the microwave discharge light source apparatus having the above-mentioned construction, light emitted from the lamp 9 is almost radiated outside through the metallic mesh 7 directly. Accordingly, use of a light reflecting plate placed outside the microwave resonance cavity 5 effectively reflects the light and therefore, it is easy to control light. Further, it is possible to design the light reflecting plate without causing adverse effect to microwave characteristic of the microwave resonance cavity 5 since the light reflecting plate is provided the outside of the cavity 5. However, the conventional apparatus has disadvantages that since a mesh formed by knitting fine metallic wires (hereinbelow referred to as wires) as the metallic mesh 7 is usually used, the metallic mesh 7 may be broken due to over-heating by microwave loss which is caused by electrical contact resistance at crossing parts of the wires and efficiency of power feeding to the lamp 9 is poor, hence luminous efficiency is low. Further, the mesh is weak in mechanical strength. When an external force is applied to the mesh, the microwave resonance cavity 5 is deformed. In this case, resonance condition of the microwaves can not be maintained and incidence of microwave power into the microwave resonance cavity 5 is difficult. This causes reduction in power for effecting electric discharge in the lamp. Further, when the microwave resonance cavity 5 is deformed, there causes unevenness in the openings of the metallic mesh 7 (the distance between wires), whereby microwaves may leak from the microwave resonance cavity 5 at portions having large openings.

It is an object of the present invention to eliminate the disadvantages of the conventional apparatus and to provide a microwave discharge light source apparatus in which discharge in a lamp is effectively conducted, a microwave resonance cavity is mechanically strengthened and a problem of deformation of the cavity is prevented, by constructing the apparatus in such a manner that a microwave resonance cavity has a wall surface, a substantial part of which is constituted by a light transmitting member and wires crossed each other to form a mesh are electrically jointed integrally and without any contact resistance at each crossing point.

It is an object of the present invention to provide a microwave discharge light source apparatus for eliminating a starting lamp and assuring reliability of starting operation by projecting a hollow supporting bar outside of the wall of an electrodeless discharge lamp and containing a rare gas and mercury for starting operation in the hollow portion of the supporting bar.

An aspect of the present invention is to provide a microwave discharge light source apparatus comprising a microwave resonance cavity having a wall surface, a substantial part of which is constituted by a light transmitting member, the microwave resonance cavity receiving microwaves from a waveguide through a power feeding port, a lamp placed in the microwave resonance cavity at such a position that the sum of three-dimensional angles formed by extension lines from a point in the lamp to the light transmitting member is $2\pi$ steradian or more, wherein the light transmitting member is formed by a mesh having a conductive surface and wires crossed each other to form the mesh are electrically jointed integrally and without any contact resistance at each crossing point.

Figure 3A:
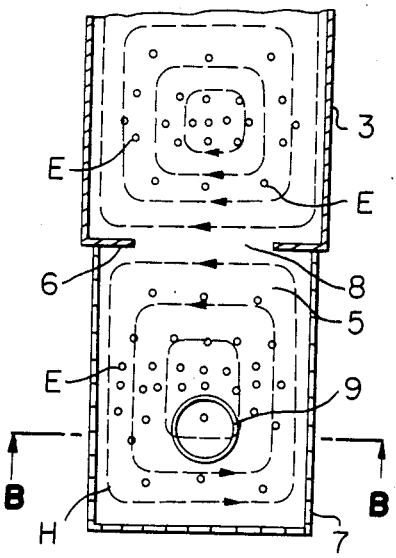
Figure 3B:
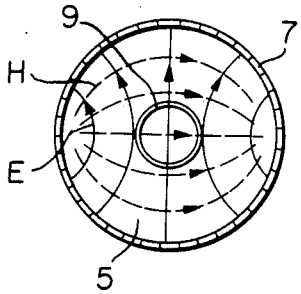

FIG. 3*a* is a longitudinal cross-sectional view showing a mode pattern of an embodiment of the microwave resonance cavity of the present invention;

FIG. 3*b* is a transverse cross-sectional view taken along a line B—B in FIG. 3*a;*

Figure 7:
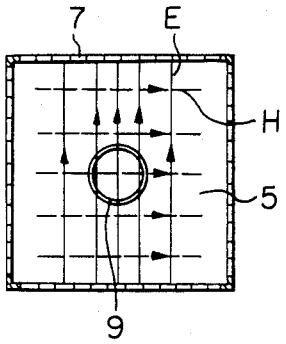
Figure 12:
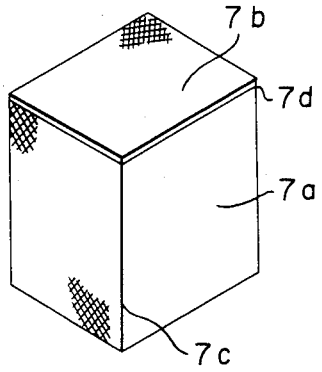
Figure 13:
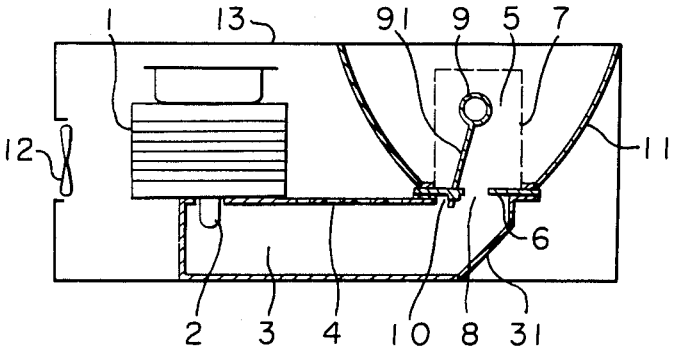
Figure 14:
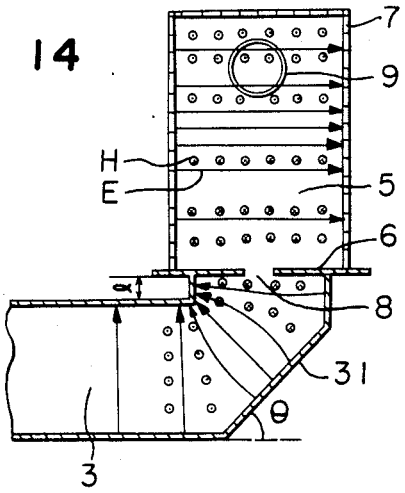
Figure 15:
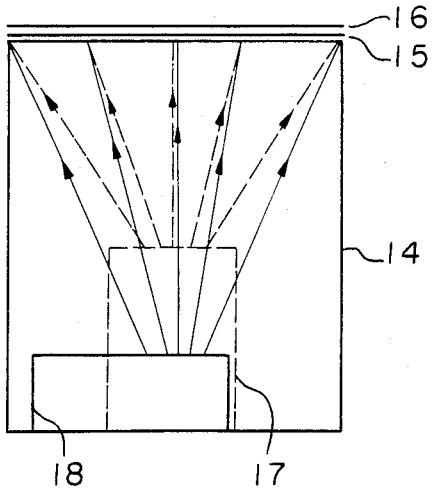
Figure 16:
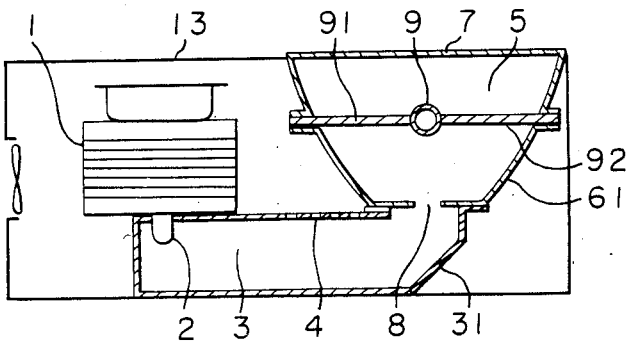
Figure 23:
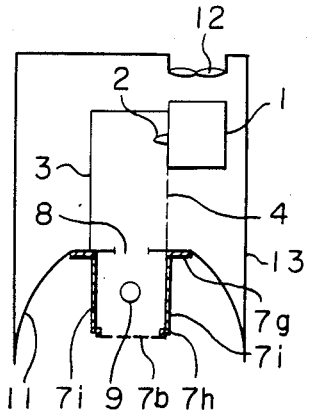
Figure 24:
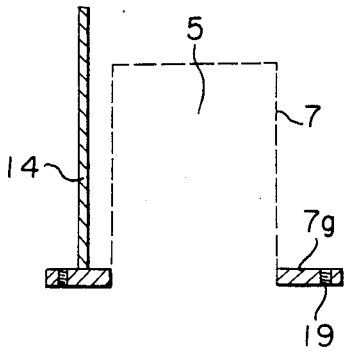
Figure 25:
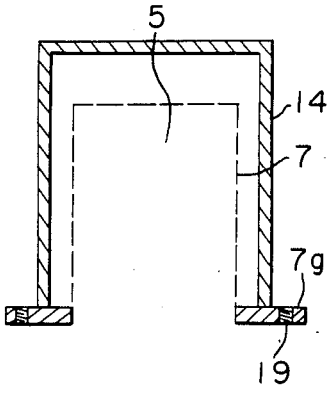
Figure 26:
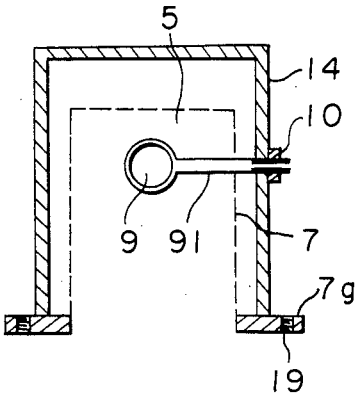
Figure 27:
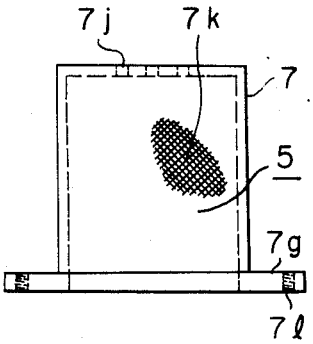
Figure 28:
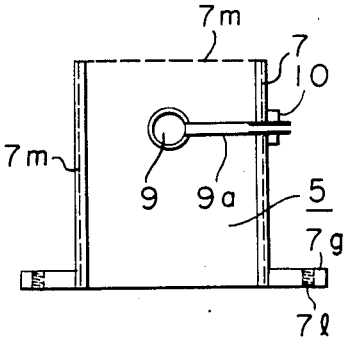
Figure 29:
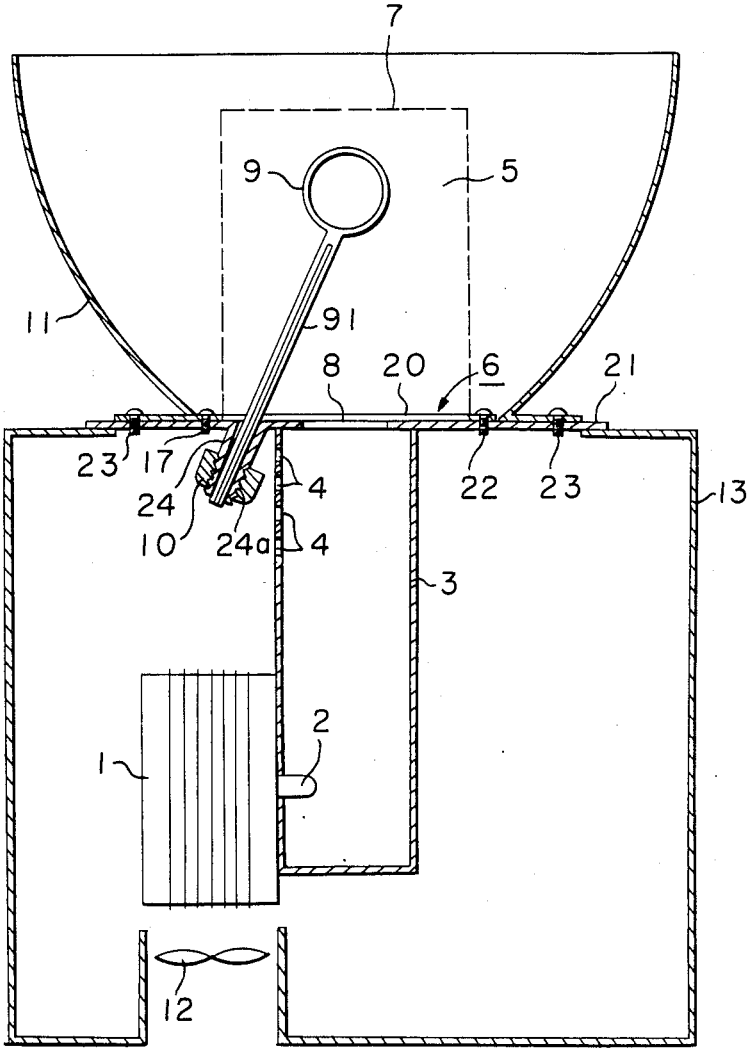
Figure 30:
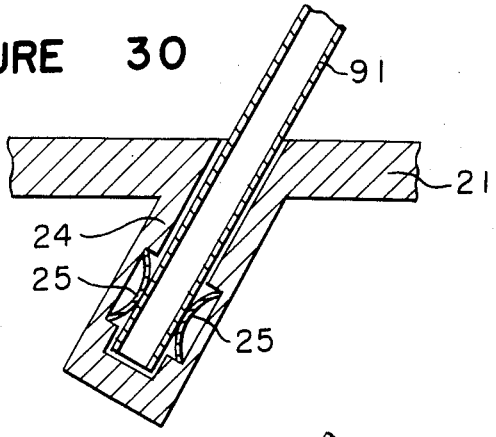
Figure 31:
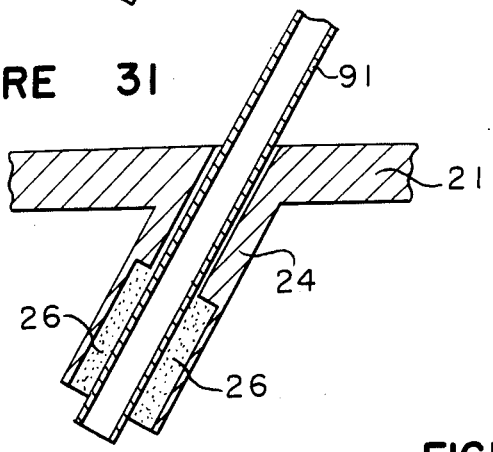
Figure 33:
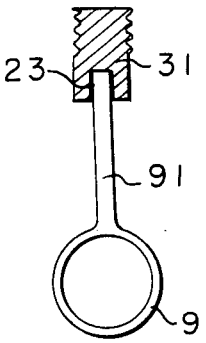
Figure 32:
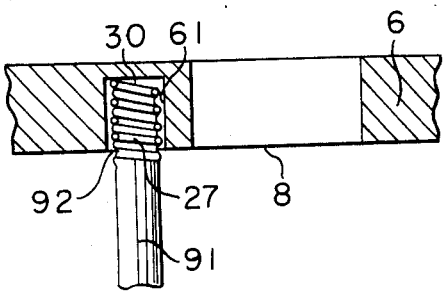
Figure 34:
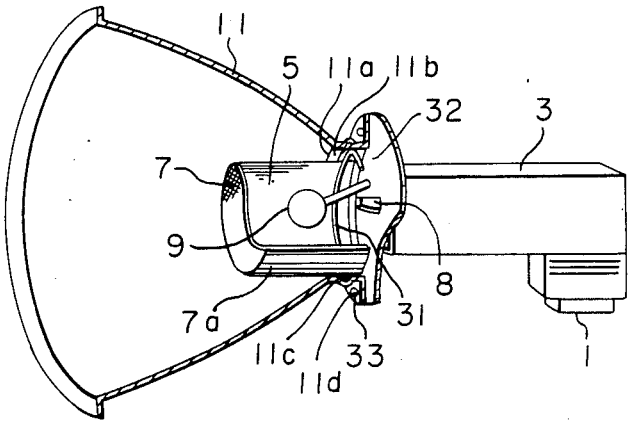
Figure 35:
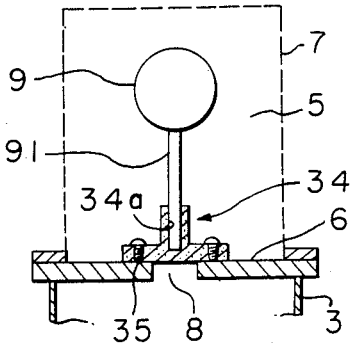
Figure 36:
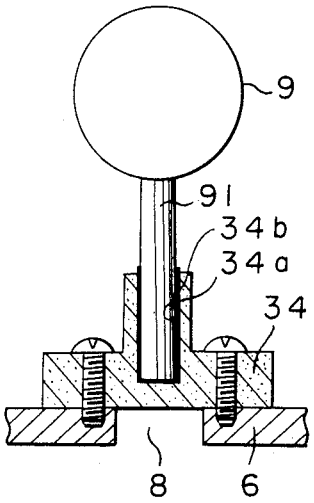
Figure 37:
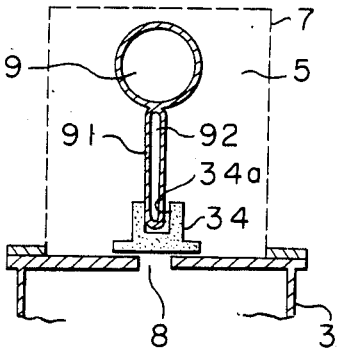

FIG. 4 is a schematic view of a metallic mesh suitably used for the apparatus of the present invention;

FIG. 5 is an enlarged perspective view of a mesh before application of metal-plating in a case that a metallic mesh is formed by metallic wires in a network form;

FIG. 6 is an enlarged cross-sectional view of the mesh in FIG. 5 after application of plating;

FIG. 7 is a cross-sectional view showing a mode pattern of another embodiment of the microwave resonance cavity of the present invention;

FIGS. 8, 9, 10 and 11 are respectively front views of several embodiments of the microwave resonance cavity of the present invention;

FIG. 12 is a perspective view of still another embodiment of the microwave resonance cavity of the present invention;

FIG. 13 is a cross-sectional view of an important part of another embodiment of the microwave discharge light source apparatus of the present invention;

FIG. 14 is a cross sectional view partly omitted showing radiation of microwaves from a waveguide to a microwave resonance cavity in accordance with the present invention;

FIG. 15 is a diagram showing a film printing apparatus in which an embodiment of the microwave discharge light source apparatus of the present invention is used;

FIG. 16 is a cross-sectional view of an important part of another embodiment of the microwave discharge light source apparatus of the present invention;

FIGS. 17, 18, 19, 20, 21 and 22 are respectively diagrams of several embodiments of the microwave resonance cavity of the present invention;

FIG. 23 is a diagram showing another embodiment of the microwave discharge light source apparatus of the present invention;

FIG. 24 is a cross-sectional view of an embodiment of the light transmitting member used for a microwave discharge light source apparatus of the present invention;

FIGS. 25 and 26 are cross-sectional view of other embodiments of the light transmitting member of the present invention;

FIG. 27 is a cross-sectional view of another embodiment of the microwave cavity resonator of the present invention;

FIG. 28 is a side view partly cross-sectioned of the resonator including a lamp of the present invention;

FIG. 29 is a longitudinal cross-sectional view of another embodiment of the microwave discharge light source apparatus of the present invention;

FIGS. 30 and 31 are respectively cross-sectional views of embodiments of a discharge lamp supporting means of the present invention;

FIG. 32 is an enlarged cross-sectional view of another embodiment of the lamp supporting means used for the present invention;

FIG. 33 is a cross-sectional view of another embodiment of the lamp supporting means;

FIG. 34 is a perspective view partly cross-sectioned of another embodiment of the microwave discharge light source apparatus of the present invention;

FIG. 35 is a cross-sectional view of another embodiment of the microwave cavity of the present invention;

FIG. 36 is a cross-sectional view of another embodiment of the microwave cavity of the present invention; and FIG. 37 is a cross-sectional view of another embodiment of the microwave discharge light source apparatus.

Preferred embodiments of the present invention will be described with reference to drawing.

Figure 2:
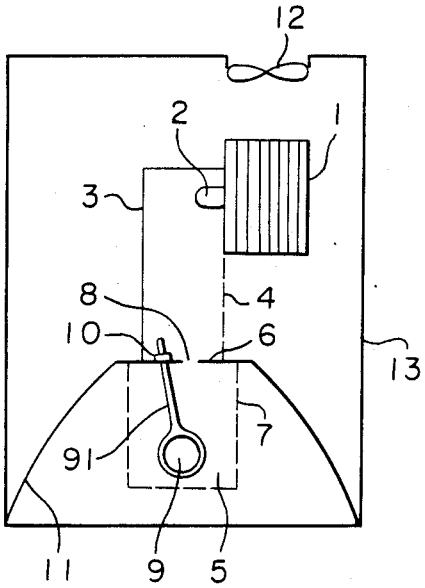
FIG. 2 is a diagram showing an embodiment of the microwave discharge light source apparatus according to the present invention.

FIG. 2 shows an embodiment of the microwave discharge light source apparatus of the present invention. In the Figure, a reference numeral 4 designates a ventilating opening and a numeral 5 designates a cylindrical microwave resonance cavity. At least a part of the wall surface of the microwave resonance cavity 5 is provided with a light transmitting member 7. The light transmitting member 7 is constituted by an electrically continuous metallic mesh and so formed that the sum of three-dimensional angles formed by extension line extending from a point in a lamp 9 to the light transmitting member 7 is $2\pi$ steradian or more. A power feeding port 8 is formed in a cavity wall 6 made of metal at a position to be connected to a waveguide 3 to feed microwaves from the waveguide 3 into the microwave resonance cavity 5. The lamp 9 is made of a light transmission substance such as quartz glass and contains a rare gas and mercury and so on. A lamp supporting member 91 made of a dielectric substance such as quartz glass extends from the outer wall of the lamp 9 and is fixed to the cavity wall 6 by means of a screw 10 so that the lamp 9 is secured to the cavity wall 6. A light reflecting plate 11 surrounds the microwave resonance cavity 5 to reflect light emitted from the cavity 5. A reference numeral 12 designates a cooling fan for cooling the magnetron 1 and the lamp 9 and numeral 13 designates a casing for covering the above-mentioned elements.

The operation of the apparatus of the present invention is as follows.

Microwaves are excited at transmission mode from the magnetron 1 through the magnetron antenna 2 to the waveguide 3. The microwaves are fed to the microwave resonance cavity 5 surrounded by the cavity wall 6 and the metallic mesh 7 through the power feeding port 8. Rare gas contained in the lamp 9 is initiated to discharge by the microwaves and the lamp wall is heated by energy of the microwaves. The discharge of the gas causes evaporation of mercury and electric discharge of metallic gas such as mercury gas is mainly resulted. Thus, luminescence is resulted at absorption spectra depending on a kind of the metallic gas.

The metallic mesh 7 functions to reflect the microwaves as metal do and allows light to pass through the openings of the mesh. Namely, the metallic mesh 7 functions as an opaque body for the microwaves and functions as a transparent body for light. Accordingly, light from the lamp 9 is emitted outside through the microwave resonance cavity 5 and reflected at the light reflecting plate 11. The reflecting plate 11 can be designed to have various shapes depending on how light is used. Since the light reflecting plate 11 is positioned outside of the microwave resonance cavity 5, design of the light reflecting plate is possible from the optical viewpoint without consideration of affect to microwave characteristics. The microwave power supplying method used in the above-mentioned embodiment is useful for radiating low grade resonance mode and the low grade resonance mode reduces the size of the microwave resonance cavity 5.

FIG. 3*a* is a longitudinal cross-sectional view showing a mode pattern of an embodiment of the cylindrical microwave resonance cavity of the present invention and FIG. 3*b* is a transverse cross-sectional view taken along a line B—B in FIG. 3*a*. FIG. 3*a* shows in detail connection between transmission mode in the waveguide 3 and resonance mode in the microwave resonance cavity 5. In Figures, solid lines and small circles E represent the lines of electric force, i.e. an electric field and dotted lines H represent the lines of magnetic force i.e. a magnetic field. The mode in the waveguide 3 is a square $TE_{10}$ mode and the mode in the microwave resonance cavity 5 is a cylindrical $TE_{111}$ mode, namely, excitation of the microwaves is effected with modes in which there is a single projection of electromagnetic field in every direction. As is understandable from the Figures, connection of the modes is easy because the directions of the electric field and the magnetic field in the waveguide 3 and the microwave resonance cavity 5 are coincident. When discharge is caused in the lamp 9, it is considered that the mode in the microwave resonance cavity 5 is substantially same as the mode shown in the Figure. Accordingly, connection of the modes is also easy. In fact, the microwave resonance cavity 5 is so designed that resonance is caused under constant discharging condition of the metallic gas such as mercury in the lamp 9. A constant of the microwave of the lamp 9 varies depending on evaporation of the metallic gas until the discharge becomes normal after initiation of the discharge. On account of this, the microwaves are out of condition of resonance until reaching the normal condition. Even in this condition, however, microwave energy necessary to evaporate metal can be supplied from the waveguide 3 to the microwave resonance cavity 5 to cause discharge of the lamp 9 without providing any means for changing the condition as the time goes, in the waveguide 3 or the microwave resonance cavity 5. This is because the microwave resonance cavity 5 is small and a relatively strong microwave electromagnetic field is produced even though the microwave is out of the condition of resonance. Accordingly, energy can be supplied to the lamp 9 at the initiation of discharge whereby evaporation of metal quickly takes place and normal condition is obtainable for a short time. A test was conducted by using an apparatus in which the waveguide 3 has a square shape in cross section of 95 mm×54 mm, the microwave resonance cavity 5 is of a cylindrical cavity having a diameter of 80 mm and a height of 90 mm and the lamp 9 is of a spherical shape having a diameter of 30 mm, in which 60 Torr of argon and 100 mg of mercury are filled. It has been revealed that when microwaves of a frequency of 2450 MHz and power of 800 W, it takes about 5 seconds before reaching normal condition and coefficient of power reflection of the microwaves is 0.1 or below under the condition that matching of the waveguide and the microwave resonance cavity is normal.

The light transmitting member 7 consisting of a metallic mesh used in the test is formed in such a manner that stainless steel sheet of 0.1 mm thick is subjected to etching to form it in a lattice form in which the pitch of lattice is 1 mm and the width of wire is 0.1 mm. In the conventional mesh formed by knitting thin metal wires, the wires have contact points, namely they are electrically connected through contact resistors. On the contrary, the metallic mesh formed in accordance with the embodiment is electrically continuous. Accordingly, loss in a wall surface current flowing in the inner wall of the microwave resonance cavity 5 is small, whereby the metallic mesh is not heated by the microwaves, hence the lamp 9 is supplied with power to increase efficiency of discharging. Further, each crossing point of wires 71 which form a metallic mesh is integral, on account of which the mesh is mechanically rigid and therefore, when the cavity 5 is formed in a three-dimensional structure by using the metallic mesh, there is no problem of deformation of the cavity by an external force at the time of installation of it or by application of heat from the lamp in the discharging. Accordingly, there is no risk of reduction in power which causes discharge of the lamp. Supply of the power to the lamp means that much energy is supplied to the lamp at the initial stage of discharging and the discharge reaches normal condition at a shorter time. The metallic mesh 7 may be formed by perforating a thin metallic plate by using a laser rather than subjecting it to etching operation. The same effect can be obtained by perforating a thin metal plate by using other technique than the laser. It is also possible to form a metallic mesh by knitting thin metallic wires as shown in FIG. 5 or by plating a mesh made of resinous material or by subjecting it to metal vapour deposition to form a metallic layer 711 thereby forming electrically continuous surface. With this structure, loss of the microwave can be minimized to improve efficiency. Further, the mesh is mechanically strengthened and performs the same function as that obtained by the etching operation.

FIG. 7 is a transverse cross-sectional view showing a mode pattern of another embodiment of an angular type microwave resonance cavity of the present invention. Electromagnetic mode in a cross-sectional view is analogous to that shown in FIG. 3*a*. The mode is called a square $TE_{111}$ mode which allows connection of microwaves from the waveguide 3 to the microwave resonance cavity 5. As similar to the embodiment shown in FIG. 3, a test was conducted by using the same waveguide 3 and the lamp 9 as those in FIG. 3 and an rectangular type microwave resonance cavity 5 having a square shape in cross section, a side of which is 80 mm long and having a height of 80 mm. With use of microwaves of a frequency of 2450 MHz and a power of 800 W, it took about 5 seconds before reaching normal condition and coefficient of power reflection of microwave was about 0.1.

Thus, an effective part of the light reflecting plate 11 provided outside of the microwave resonance cavity 5 can be large by reducing the maximum dimension in cross section of the microwave resonance cavity 5 which is parallel to the power feeding port 8 and by utilizing low grade mode in cross section as shown in FIGS. 3*b* and 7. Accordingly, allowability in design of the light reflecting plate is increased and efficiency of light is improved. However, excitation of the microwave becomes difficult when the maximum dimension in cross section of the microwave resonance cavity 5 in parallel to the power feeding port 8 is less than half of the wavelength of the microwave, while the advantage as above-mentioned can not be obtained, when the dimension is more than two times of the wavelength of the microwave. Namely, there is limitation in the allowability in design of the light reflecting plate 11. Substantially the same performance as in FIGS. 3 and 7 can be attained when mode causing excitation of the microwave at the above-mentioned range is used.

Figure 8:
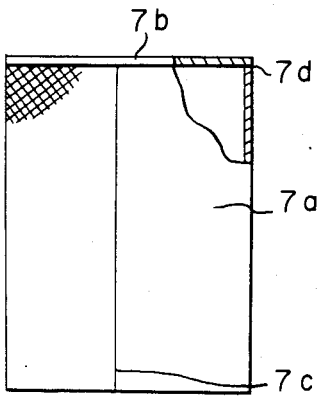

FIG. 8 shows another embodiment of the microwave resonance cavity of the present invention in which a reference numeral 7*a* designates a first element formed by rolling a flat mesh member into a cylindrical shape with both ends opened, a numeral 7*b* designates a second element made of a flat mesh member which is jointed to one of the open ends of the cylindrical first element 7*a* to constitute a closing part to capture the microwaves in the first element, a numeral 7*c* designates a joint portion of the cylindrical first element, a numeral 7*d* designates a joint portion between the first and second elements 7*a*, 7*b*. The jointing operation is conducted by welding or brazing to electrically connect the joint portions.

Figure 9:
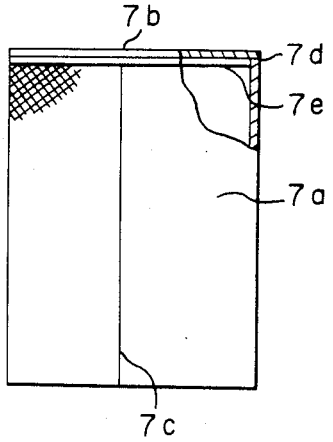

In the microwave resonance cavity as another embodiment shown in FIG. 9, a annular member 7*e* is arranged to joint the first and second elements 7*a*, 7*b* along the inner circumferential portion of one of the open ends of the first element 7*a*.

Figure 10:
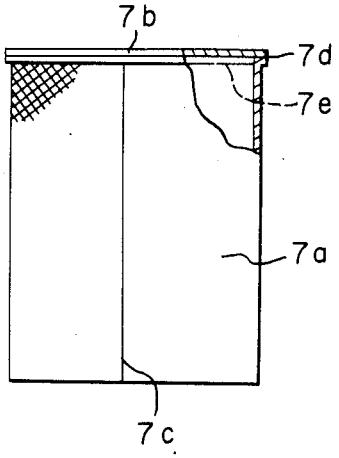

In the microwave resonance cavity as another embodiment as shown in FIG. 10, a annular metallic member 7*e* is provided along the outer circumferential portion of one of the open ends of the first element 7*a* in order to joint the first and second elements 7*a*, 7*b*.

Figure 11:
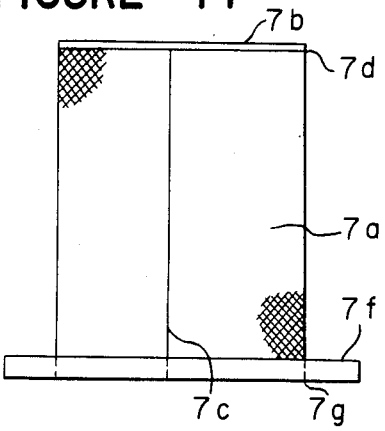

Further, in the microwave resonance cavity as another embodiment shown in FIG. 11, a reinforcing flange 7*f* is attached along the outer circumferential portion of the other open end of the first element 7*a* in which a reference numeral 7*g* designates a joint portion between the first element 7*a* and the reinforcing flange 7*f*.

FIG. 12 shows a quadrate column type microwave resonance cavity of another embodiment of the present invention. The microwave resonance cavity comprises a first element 7*a* formed by bending a flat mesh member into a quadrate column shape with both ends opened and a second element *7b* made of a flat mesh member which is jointed at one of the open ends of the first element *7a* to capture the microwaves therein.

In practical use of a microwave discharge light source, leakage of the microwave should be minimized and transmittance of light should be large, these characteristics being contradictory. Accordingly, there is an optimum value for the microwave resonance cavity. It has been found in experiments that the optimum value of transmittance of 90% can be obtained by using the first and second mesh elements *7a, 7b,* each being formed by photo-etching a thin stainless steel sheet of 0.1 mm thick into a lattice form in which the pitch of the lattice is 1 mm and the width of wires is 0.1 mm. The light transmitting member 7 is constituted by the first and second elements *7a, 7b* made of a flat mesh member. Each of the first and second elements is formed by processing a single mesh sheet material and bonded them together. Accordingly, it is easy to control a rate of openings, hence manufacture of the light transmitting member is easy. In the microwave resonance cavity shown in FIG. 8, the joint portion *7c* of the first element *7a* and the joint portion *7d* between the first and second element *7a, 7b* are jointed by welding or brazing. This jointing method provides reinforcing effect to the cylindrical light transmitting member 7 in a net form which has a mechanical strength greater than a spherical mesh member. Accordingly, it sufficiently withstands at the time of assembling, maintenance and inspection, whereby there is no problem of deformation or breakdown.

In the microwave resonance cavity shown in FIGS. 9 and 10, an annular member *7e* is placed at the joint portion *7d* between the first and second elements *7a, 7b* and the annular member *7e* is jointed by means of, for instance, spot welding along the inner or outer circumferential portion of the first and second elements. Accordingly, the cylindrical light transmitting member 7 in a mesh form has much mechanical strength. In the cylindrical light transmitting member 7 shown in FIG. 11, the reinforcing flange *7f* is jointed by, for instance, spot welding along the outer circumferential portion of the open end at the side of power feeding port of the first element *7a,* to increase a mechanical strength. The rectangular-shape mesh member shown in FIG. 12 also provides a mechanically strengthened microwave resonance cavity.

FIG. 13 is a cross-sectional view of an important part of the microwave discharge light source apparatus according to another embodiment of the present invention. In the embodiment shown in FIG. 13, a corner portion 31 is formed in the waveguide 3 so that the surface of the power feeding port 8 is not perpendicularly crossed to the longitudinal axes of the waveguide to which the magnetron 1 is mounted. The waveguide 3 is a square type waveguide. FIG. 13 shows a cross-sectional view which is normal to the direction of an electric field E and the corner portion is an E corner. On the other hand, FIG. 14 is a cross sectional view showing distribution of the electric field E and the magnetic field H in the waveguide and resonance cavity shown in FIG. 13. In FIG. 14, the solid lines E represents the lines of electric force namely an electric field and small circles H represent the lines of magnetic force, namely a magnetic field. The microwave resonance cavity 5 shown in FIG. 14 is of a cylindrical form. The mode in the waveguide 3 is a square $TE_{10}$ mode and the mode in the microwave resonance cavity 5 is a cylindrical $TE_{111}$ mode, namely, there is a single projection in an electromagnetic field in every direction. As shown in Figure, in the $TE_{10}$ mode in the waveguide 3, the directions of the electric field and the magnetic field are both changed. In this case, an angle $\theta$ of the corner portion 31 is 45° to change the direction of the electric field and the magnetic field at a right angle. Accordingly, the electromagnetic field mode at the side of waveguide of the power feeding port 8 is a good approximation of the $TE_{10}$ mode even though the length l of the waveguide is a quater or smaller as large as the wavelength in the waveguide as shown in FIG. 14. Accordingly, the cylindrical microwave resonance cavity used in the embodiment shown in FIG. 2 is applicable to the microwave resonance cavity of this embodiment. Namely, excellent excitation of the $TE_{111}$ mode in the cylindrical resonance cavity can be attained from the $TE_{10}$ mode in the square waveguide as shown in FIG. 14. In this case, it might be necessary to modify the shape of the power feeding port shown in FIG. 1 because the mode at the waveguide side is not entirely same as the $TE_{10}$ mode when a value l is small although the same resonance cavity can be used.

A test was conducted by using a square type waveguide 3 having a cross secitonal area of 95 mm×54 mm in which the angle $\theta$ of the corner portion is 45° and the length of l is 8 mm, a cylindrical microwave resonance cavity 5 having a diameter of 80 mm and a height of 90 mm, and a spherical lamp 9 having a diameter of 30 mm in which 60 Torr of argon and 100 mg of mercury are filled. When excited microwaves of a frequency of 2450 MHz and a power of 800 W is used, it took about 5 seconds before reaching normal condition and coefficient of power reflection of the microwave was 0.1 or lower in the condition that matching of the waveguide and the microwave resonance cavity is normal. When the corner portion having the construction as above-mentioned is used, good characteristics can be obtained even though the length from the corner portion to the power feeding port is short, particularly even though l=0. Namely, excellent characteristic can be obtained even in the case of the length l being $\frac{1}{2}$ of the wavelength in the waveguide or lower (it is considered that mode other than the $TE_{10}$ mode as a principal mode is mixed at the power feeding port).

The operation of the microwave discharge light souce apparatus having the construction as above-mentioned used for a light source or a film printing apparatus is as follows.

Figure 1:
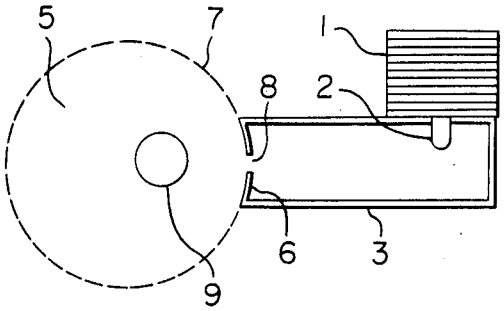
FIG. 1 is a diagram showing a conventional microwave discharge light source apparatus.

FIG. 15 shows diametrically the film printing apparatus in which the microwave discharge light source apparatus is placed at a position 17 or 18 in a casing 14. The microwave discharge light source apparatus placed at the position 17 indicated by the dotted line is the same as the embodiment as shown in FIG. 1 provided that it inversely stands and the apparatus at the position 18 indicated by the solid line is the same as the apparatus as shown in FIG. 13. A film to be printed 15 and a printing film 16 are overlaid on the top surface of the frame 14. The printing film 16 is exposed to light from the light source apparatus whereby image transfer is performed from the printed film 15 to the printing film 16. A plurality of films to be printed may be overlaid for the purpose of edition. In this case, the overlaid films has a substantial thickness. Accordingly, an image to be printed to the printing film 16 becomes out of focus unless the incident angle of light is normal to the surface of the films. Accordingly, the light should be normal to the film surface, namely the light should be parallel light. When the microwave discharge light source apparatus is arranged in the position 17 in FIG. 15, a light beam is spread as indicated by the dotted arrow marks, which is apparently different from the parallel light. On the other hand, when the light source apparatus is placed at the position 18, the position of the light source can be lowered and the light beam irradiated to the object surface becomes a substantial parallel light as shown by the solid arrow marks. Accordingly, an image to be printed is well focused and high quality printing is possible.

FIG. 16 shows another embodiment of the microwave discharge light source apparatus of the present invention. In FIG. 16, the microwave resonance cavity 5 is constituted by a cavity wall 61 formed by revolution symmetric which serves a light reflecting plate and the light transmitting member 7. The spherical lamp 9 is supported by two supporting bars 91 from both sides. In this case, an electromagnetic field mode in the microwave resonance cavity 5 is different from that of FIG. 13. However, mode excited by the $TE_{10}$ mode in the waveguide can be used to attain excitation even though there is a corner portion 31 in the waveguide. Accordingly, the length in the direction radiating light from the light source can be small by providing the corner portion, thus, the same function as in FIG. 13 can be obtained.

In the embodiments shown in FIGS. 13 and 16, description has been made as to the corner portion having the E corner. However, the same function can be obtained by using an H corner.

The above-mentioned embodiments has the longitudinal axis of the waveguide, to which a mignetron is mounted, in parallel to the surface of the power feeding port. However, they may have a relation of inclination other than a relation of orthogonally intersecting. The latter provides an advantage of reduction in length. Even in this case, it is possible to obtain a desired mode.

Several embodiments of the modified microwave cavity 5 in accordance with the present invention will be described.

Figure 17:
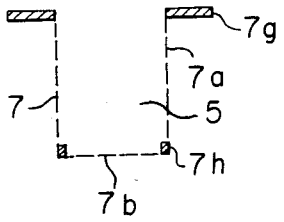

In the microwave cavity 5 shown in FIG. 17, a first reinforcing member *7h* consisting of a metallic ring having a rectangular shape in cross section is provided along the inner rectangular portion of the boundary between a first element *7a* of a cavity wall and a second element *7b* of a cavity top surface which opposes the power feeding port (not shown).

Figure 18:
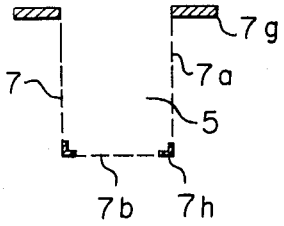

In the embodiment shown in FIG. 18, the first reinforcing member *7h* having an L shape in cross section is used as the metallic ring.

Figure 19:
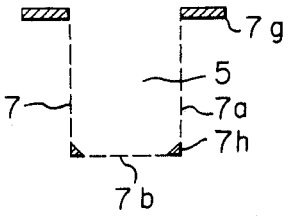

In the embodiment shown in FIG. 19, the first reinforcing member having a triangle having a right angle in cross section is used for the metallic ring.

Figure 20:
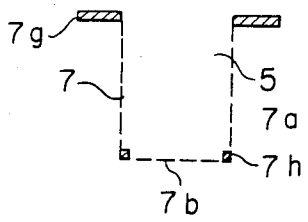

FIG. 20 shows a microwave cavity 5 in which the first reinforcing member *7h* having a circular shape in cross section is used for the metallic ring.

In a case that the microwave cavity 5 as above-mentioned is fabricated by the first element *7a* constituting a cylindrical side surface and the second element *7b* as a disc-like top surface, the joint portion between the both elements is connected to the reinforcing member by spot welding.

Figure 21:
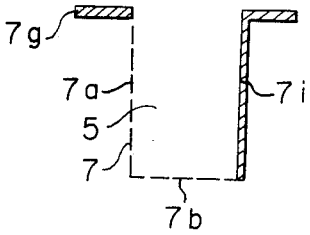

In the microwave cavity 5 shown in FIG. 21, a second reinforcing member *7i* of a metallic bar having a rectangular shape in cross section is attached to the first element *7a* of a cylindrical side surface along the axial line of the cylindrical cavity.

Figure 22:
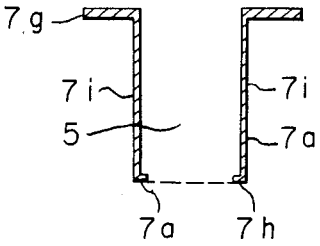

In the microwave cavity 5 shown in FIG. 22, two metallic bars as the second reinforcing member are attached to the first element *7a* constituting a cylindrical side surface in a diametrically opposing position and along the axial direction of the cylindrical body. In addition, the first reinforcing member *7h* of a metallic ring having a rectangular shape in cross section is provided along the boundary between the first element *7a* of the side surface of the cavity and the second element *7b* of the top surface of the cavity. In this case, each end of the second reinforcing members *7i* is connected to the first reinforcing member *7h* and the other end is connected to a flange *7g* by spot welding respectively. FIG. 23 is a cross sectional view of the microwave discharge light source apparatus in which the microwave cavity 5 shown in FIG. 22 is used. The operation of the apparatus is as follows. Microwaves emitted into the microwave cavity 5 produce a microwave electromagnetic field in the cavity to cause radiation of light in the discharge lamp by discharging. The light is emitted outside at a transmission rate which depends on the thickness of the metallic mesh and a ratio of openings of the cavity. For instance, in order to increase light transmission property and keep an amount of leakage of the microwave at a fixed value or lower, the metallic mesh is so formed that a metallic plate having a thickness of 0.1 mm–0.2 mm is subjected to photo-etching operation to be a mesh plate having a pitch of 1 mm and a wire diameter of 0.1 mm. The microwave cavity is fabricated by using the mesh plate as follows. A top surface of the cavity as the second element *7b* and a cavity side surface as the first element *7a* are separately prepared from the metallic mesh sheet material. The first reinforcing member *7h* of the metallic ring is connected to the metallic mesh of the second element *7b* by spot welding. The side surface *7a* of the cavity is formed by rolling a flat metallic mesh into a cylindrical form. The joint portion of the cavity surface and a portion diametrically opposing the joint portion are respectively connected to the second reinforcing members *7i* of metallic bars by spot welding. Then, each one end of the reinforcing members *7i* is connected to the first reinforcing member *7h* and each other end is connected to the flange *7g* by spot welding, thus the microwave cavity 5 is assembled. Provision of the reinforcing members in the microwave cavity 5 prevents deformation of the microwave cavity 5 caused by thermal reflection during the operation of the lamp and handling at the time of replacement of the lamp or manufacturing steps.

A rectangular-shaped microwave cavity may be used instead of the cylindrical cavity. In this case, it is preferable to provide a metallic bar at the corner portion. Further, it is preferable that the reinforcing member has a thermal expansion factor substantially the same as that of the microwave cavity to prevent deformation of the cavity due to difference in the thermal expansion factors.

Another embodiments of the microwave resonance cavity of the present invention will be described.

In FIG. 24, a reference numeral 5 designates the microwave resonance cavity and a numeral 7 designates the light transmitting member, both being the same as those in FIG. 1. A flange *7g* is connected to the light transmitting member 7 at the outer surface of the open end at the side of the wave guide 3. A frame 14 is secured to the flange *7g*. The flange *7g* is provided with a plurality of threaded holes 19 to be connected to the cavity wall. The frame 14 is secured to the cavity wall through the flange *7g* (the light tansmitting member is not directly secured to the cavity wall). With this structure, the frame 14 is held without any contact with the light transmitting member 7 and the light transmitting member 7 can be independently attached to and removed from the cavity wall.

FIG. 25 is a cross-sectional view showing another embodiment of the microwave resonance cavity. In FIG. 25, a frame 14 in a channel shape in cross section is placed on the flange *7g* in an offset state to cover the light transmitting member and both ends is connected to the flange *7g*.

FIG. 26 is a cross-sectional view of the microwave resonance cavity including a supporting part for fixing an electrodeless lamp 9 according to another embodiment of the present invention. In FIG. 26, a lamp supporting par 91 of the electrodeless lamp 9 is secured to the flame 14 placed at the outer side of the light transmitting member 7. In the embodiments described above, two or more number of frames 14 may be used although description has been made as to use of a single of the frame 14. The electrodeless lamp 9 may be supported at a desired position other than that shown in FIG. 26.

FIG. 27 is a side view of still another embodiment of the microwave cavity resonator. In the Figure, a reference numeral 7 designates a light transmitting member made of a material inhibiting transmission of the microwave which is a component of the microwave resonance cavity 5. The light transmitting member 7 has a metal layer in a mesh form on the inner or outer surface of a cylindrical body of plastics or glass by plating or vapour-depositing. In the Figure, a reference numeral *7j* designates a ventilating openings, a numeral *7g* designates a fitting flange of the microwave resonance cavity 5 and a numeral 71 designates through holes for fitting screws.

In the microwave resonance cavity 5 having the construction in which a metallic mesh *7k* is formed on the light transmitting member 7 made of rigid plastic or glass by plating or vapour deposition, there is no problem of deformation or breakdown during manufacturing steps of the apparatus and in the handling operation such as replacement of the lamp and work for maintenance. Further, the lamp can be effectively cooled without causing leakage of air fed by a fan when the lamp (not shown) is cooled and air is discharged outside from the ventilating openings *7j* after the lamp has been cooled.

FIG. 28 shows another embodiment of the microwave resonance cavity 5 in which a metallic mesh *7m* is embedded in the side wall of the light transmitting member 7 made of plastics or glass. A lamp supporting bar 91 for holding the lamp 9 is secured to the side wall of the light transmitting member 7 by means of a fastening screw 10. This allows easy work of replacement of the lamp in comparison with the conventional structure.

In the embodiments described above, a mesh-formed metallic layer *7k* and the metallic mesh *7m* are electrically connected to the fitting flange *7g* of the microwave resonance cavity 5.

FIG. 29 shows another embodiment of the microwave discharge light source apparatus of the present invention. In FIG. 29, the same reference numerals as in FIG. 2 designate the same or corresponding parts and therefore, description of these parts are omitted. A reference numeral 6 designates a cavity wall of the light transmitting member made of a stainless steel mesh which has an opening at the lower portion and a flange 20 at the opening. A numeral 21 designates a bottom plate which closes the opening and is provided with a power feeding port 8 communicated with the opening. The cavity wall 6 is attached to the bottom plate 21 by means of the flange 20 fitted to screws 22 thereby to form the microwave cavity 5. A reference numeral 11 designates a light reflecting plate positioned at the outer side of the cavity wall 6 and connected to the bottom plate 21 by screws 23. A reference numeral 24 designates a cut-off pipe provided at the bottom plate 21 and the cut-off pipe 24 is provided with a taper screw portion 24*a* at a forked portion of the top end of the pipe 24. The supporting bar 91 of the electrodeless discharge lamp 9 is inserted in the cut-off pipe 24 and the screw 10 is engaged with the taper screw portion 24*a* whereby the lamp 9 is held in the microwave cavity 5.

In the microwave discharge light source apparatus having the above-mentioned construction, since the light reflecting plate 11 is independent from a microwave circuit consisting of the magnetron antenna 2, the waveguide 3, the power feeding port 10 and the microwave cavity 5 inclusive of the inner space and the inner wall surface, the light source apparatus can be designed in consideration of only the optical characteristic, i.e. control of distribution of light. Namely, design of the apparatus for various usage can be made by changing only the light reflecting plate 11. The electrodeless discharge lamp 9 is held at a desired position in the bottom plate 21 through the supporting bar 91, whereby it does not interrupt light to the light reflecting plate 11. Further, the support of the discharge lamp 9 is provided outside of the microwave circuit by means of the cut-off pipe 24 of the bottom plate 21, whereby there is no effect of the supporting means to the microwave circuit.

FIG. 30 shows another embodiment of the supporting means in the combination of the supporting bar 91 of the discharge lamp 9 and the cut-off pipe 24 in which springs 25 are placed in an annular recess in the cut-off pipe 24 to grip the supporting bar 91.

FIG. 31 shows another embodiment of the supporting means in which an adhesive 26 is filled in the recess formed in the cut-off pipe to secure the supporting bar 91.

FIG. 32 is a cross-sectional view showing another embodiment of the structure for the supporting bar 91 of the electrodeless discharge lamp 9 in which a reference numeral 61 designates a recess formed in the cavity wall 6, a numeral 27 designates a coil spring, received in the recess 61, with the lower end secured the bottom of the recess 61, a numeral 92 designates a threaded portion formed at the outer end of the supporting bar 91, the threaded portion 92 being engaged with the coil spring 27 thereby supporting the supporting bar 91 and a numeral 30 designates an elastic material having heat resistance property which is placed at the bottom of the recess 61, the elastic material 30 holding the end surface of the supporting bar 91 by contact with it.

In the above-mentioned supporting structure, any vibration and shock applied to the supporting bar 91 can be effectively absorbed since the supporting bar 91 is engaged with the coil spring 27. Further, the vibration and shock applied to both the supporting bar and the coil spring can be absorbed by the elastic material 30 since the end surface of the supporting bar is in contact with the elastic material 30 placed in the bottom of the recess 61.

For the threaded portion formed at the outer end of the supporting bar 91, a metal piece 31 having a threaded portion in the outer circumferential surface may be connected to the end of the supporting bar 91 by an adhesive 23 as shown in FIG. 33. In this case, the cavity wall 6 and the metal piece 31 can be made of material having the same coefficient of thermal expansion to increase reliability of these parts.

FIG. 34 is a perspective view partly broken of another embodiment of the microwave discharge light source apparatus of the present invention.

The light source apparatus has a trumpet-shaped reflector 11 with a light reflecting surface at the inside thereof. The reflector 11 has a front or an enlarged opening and the rear opening 11*a* at the opposite side of the enlarged opening. The opening 11*a* is provided with a cylindrical portion or an opening wall 11*b* extending backward at a relatively small length. In the inner circumferential surface of the opening wall 11*b*, an annular groove 11*c* is formed by striking the opening wall outward. A fitting flange 11*d* is formed at the end portion of the opening wall 11*b* by bending the end portion radially in the outer direction.

In the inner circumferential surface of the opening wall 11*b* of the reflector 11, a cylindrical light transmitting member having one end opened and the other end closed is inserted by fitting a pressing ring 31 placed at the other inner end into the annular groove 11*c* formed in the opening wall 11*b*. The light transmitting member 7 is set at a position that the closed end projects at the side of an effective reflecting surface of the reflector 11. The light transmitting member 7 is made of a mesh-formed metallic material hindering to transmit microwaves.

A disc-like microwave wall body 32 is fitted to the rear surface of the flange 11*d* of the reflector 11 by screws 33 so as to close the opening 11*a*, whereby the other end of the light transmitting member 7 is closed thereby to constitute the inner portion; thus providing microwave cavity 5. A power feeding port 8 is formed at the central portion of the microwave wall body 32 to lead the microwaves into the microwave cavity 5. The electrodeless lamp 9 is placed in the microwave cavity 5 by fixing it at a desired portion in the microwave wall body 32 by a suitable means (not shown).

The wave guide 3 is attached at the rear side of the microwave wall body 32 to introduce the microwaves into the power feeding port 8 and a microwave oscillator 2 is provided at the rear part of the wave guide 3 to produce the microwaves.

The light source apparatus of the present embodiment provides the following advantages. When the shape of the light reflecting surface is to be designed, restrictive elements to form the microwave circuit are only the light transmitting member 7, the opening 11*a* to secure the light transmitting member and the opening wall 11*b*. Accordingly, it is possible to design a reflecting surface having various shapes. Further, light transmission can be increased by securing the light transmitting member 7 to the reflector 11. Accordingly, the light transmitting member 7 can be formed by using a thin and fine material. Since the light transmitting member is firmly connected, it is possible to replace the lamp 9 without contacting with a relatively weak mesh portion.

FIG. 35 shows a fixing means for an electrodeless lamp in the microwave discharge light source apparatus in accordance with the present invention. In FIG. 35, the fundamental structure is the same as the conventional structure shown in FIG. 1 and therefore, description on the same or corresponding parts is omitted.

In the embodiment shown in FIG. 35, a flange member 34 is formed at the top end of the lamp supporting bar 91 projecting from the lamp wall. The flange member 34 is made of ceramics. The lamp supporting bar 91 is inserted into an insertion hole 34*a* formed at a part of the flange member 34 and cement consisting mainly of water glass is filled in the insertion hole to bond the supporting bar 91. The flange member 34 is placed in the cavity 5 to bridge the power feeding port 8 and fixed to the cavity wall 6 by means of two bolts 35.

In the microwave discharge light source apparatus having the above-mentioned construction, the lamp 9 is secured to the cavity wall 6 by the two bolts 35; the flange member 34 is in contact with the cavity wall 6 at a relatively broad area and the flange member 34 has a longer insertion hole for the supporting bar, whereby the lamp can be certainly secured at a position in the cavity and there causes no error when a light source is subjected to vibrations by an external force.

Use of material such as metal for the flange member results in introduction of a highly conductive member in the cavity to thereby largely change an impedance in the cavity, with the consequence that it is difficult to feed a sufficient amount of the microwaves into the cavity. Accordingly, a dielectric material such as ceramics is desirable for the flange member.

In the above-mentioned embodiment, the flange member 34 and the supporting bar 91 is bonded together by use of cement. However, it is possible to use a detachable structure, namely the supporting bar 91 is inserted into the insertion hole 34*a* of the flange member 34 which is previously attached to the cavity wall 6 to thereby secure the lamp 9. In this case, it is necessary to prevent the lamp 9 from coming off by interposing a cushion substance between the supporting bar 91 and the insertion hole 34*a*.

In another embodiment shown in FIG. 36, a cup-shaped member made of silicon is attached at the top end of the supporting bar 91. However, use of the silicon cap 34*b* is not critical, but a silicon tape may be wound on the top end of the supporting bar 91. Thus, by winding the silicon tape or attaching the silicon cap, the insertion hole 34*a* for the supporting bar having a large depth can be obtained without increasing the thickness of the cavity wall 6. Accordingly, owing to use of the cushion member, deviation of the lamp setting position can be minimized to a negligible extent.

The lamp supporting bar 91 may be a part of a discharging pipe. Namely, in manufacturing steps of the lamp, a discharge pipe is connected to the lamp for discharging air and a part of the discharging pipe is bonded at the connecting part of the lamp and the discharging pipe. Then, the discharging pipe is cut to have a predetermined length to be a supporting bar.

Another embodiment of the lamp fixing means will be described with reference to FIG. 37. In FIG. 37, the same reference numeral as in FIG. 34 designate the same or corresponding parts and therefore, description of these parts is omitted. A reference numeral 91 designates a hollow supporting bar made of the same material as the lamp, which is projected from the lamp wall of the electrodeless discharge lamp 9 toward the power feeding port 8. The supporting bar 91 is inserted into the insertion hole 34*a* formed in the flange member 34 thereby supporting the electrodeless discharge lamp 9.

A rare gas is filled in the hollow portion 92 of the hollow supporting bar 91 as well as mercury at a pressure below a saturated vapour pressure and a room temperature.

The operation of the embodiment will be described. The microwaves emitted from the magnetron and propagated in the waveguide 3 partly leaks in the cavity 5 through the power feeding port 8 to produce a weak leakage electromagnetic field in the cavity 5. However, the leakage electromagnetic field has the characteristic that it is strong near the power feeding port 8 and it becomes weak as the distance from the power feeding port is large. On account of the characteristic, electric discharge is produced at the hollow supporting bar 91 near the power feeding port 8. The discharge instantaneously spreads over the interior of the hollow supporting bar 91 to emit ultraviolet rays from the portion of discharge. On account of which, weak ionization is caused in the discharge lamp 9 due to the ultraviolet rays, whereby there is obtainable a condition allowing initiation of a sufficient discharge even by the weak leakage electromagnetic field. After, the discharging is initiated, the impedance of the cavity 5 reaches a matching condition; a strong microwave electromagnetic field is produced in the cavity; the discharge lamp 9 absorbs energy from the microwave electromagnetic field; thus, discharge and luminescence are maintained as in the conventional case.

In the above-mentioned embodiment, description has been made as to the case that mercury is filled at a pressure below a saturated vapour pressure in the hollow supporting bar 91. The same effect can be obtained by increasing an amount of mercury for reliable starting operation. Incidentally, luminescence in the supporting bar 91 is unnecessary after starting of discharge in the discharge lamp 9.

We claim:

1. A microwave discharge light source apparatus comprising a microwave resonance cavity having a wall surface, a substantial part of which is constituted by a light transmitting member, and the remaining part of which is constituted by a light reflecting plate, said light transmitting member being located within the volume defined by the light reflecting plate, said microwave resonance cavity receiving microwaves from a waveguide through a power feeding port, a lamp placed in said microwave resonance cavity at such a position that the three-dimensional angle from a point in said lamp which includes the entire light transmitting member is at least $2\pi$ steradian, characterized in that said light transmitting member is formed by a mesh member having a conductive surface and wires crossed each other to form said mesh member are electrically jointed integrally and without any contact resistance at each crossing point.

2. A microwave discharge light source apparatus comprising a microwave resonance cavity having a wall surface, a substantial part of which is constituted by a light transmitting member, said microwave resonance cavity receiving microwaves from a waveguide through a power feeding port, a lamp placed in said microwave resonance cavity at such a position that the three-dimensional angle from a point in said lamp which includes the entire light transmitting member is at least $2\pi$ steradian, characterized in that said light transmitting member is formed by a mesh member having a conductive surface and wires crossed each other to form said mesh member are electrically jointed integrally and without any contact resistance at each crossing point, aid microwave resonance cavity comprising a first element formed by rolling a flat mesh member into a cylindrical form with both ends opended and a second element of a closing part made of a flat mesh member which is fitted to one of open ends of said first element to capture said microwaves in said first element, wherein said power feeding port is arranged at the other open end of said first element.

3. The microwave discharge light source apparatus according to claim 1, wherein said microwave resonance cavity is excited by a cylindrical $TE_{111}$ mode.

4. The microwave discharge light source apparatus according to claim 1, wherein said microwave resonance cavity is excited by a square $TE_{111}$ mode.

5. The microwave discharge light source apparatus according to claim 1, wherein the maximum dimension in cross section of said microwave resonance cavity in parallel to said power feeding port is $\frac{1}{2}$ to 2 times as long as the wavelength of said microwaves.

6. The microwave discharge light source apparatus according to claim 1, wherein a corner portion is provided in said waveguide.

7. The microwave discharge light source apparatus according to claim 1 or 2, wherein said light transmitting member is provided with a reinforcing member which is placed along at least a part of said light transmitting member.

8. The microwave discharge light source apparatus according to claim 1, wherein said light transmitting member is surrounded by a member which allows transmission of light but prevents air from passing through, except for a small part.

9. The microwave discharge light source apparatus according to claim 1, wherein said light transmitting member is provided with a lamp fixing means.

10. The microwave discharge light source apparatus according to claim 1, wherein said lamp is provided with a lamp supporting bar which is integral with the lamp wall.

11. The microwave discharge light source apparatus according to claim 1 or 2, wherein said light transmitting member is fixed to a bottom plate in which said power feeding port is formed.

12. The microwave discharge light source apparatus according to claim 5, wherein a coner portion of said waveguide is an E corner.

13. The mocrowave discharge light source apparatus according to claim 6, wherein a coner portion of said waveguide is an H corner.

14. The microwave discharge light source apparatus according to claim 7, wherein said reinforcing member is a flange connected to the outer circumference of the end of the other opening of said first element to extend outwardly.

15. The microwave discharge light source apparatus according to claim 14, wherein said reinforcing member has a fixing means to fix a lamp supporting member of said lamp.

16. The microwave discharge light source apparatus according to claim 7, wherein said reinforcing member is secured to an end portion of said waveguide.

17. The microwave discharge light source apparatus according to claim 7, wherein said reinforcing member is placed at the outer side of said light transmitting member in a non-contact state.

18. The microwave discharge light source apparatus ccording to claim 8, wherein said surrounding member for surrounding said light transmitting member is made of plastics or glass.

19. The microwave dischrage light source apparatus according to claim 10 wherein said lamp is provided with said lamp supporting bar which is secured to a bottom plate.

20. The microwave discharge light source apparatus according to claim 16, wherein said lamp supporting bar is connected by means of a cut-off pipe formed in the bottom plate, said cut-off pipe being provided with a tapered, threaded portion formed in the forked part at the top thererof.

21. The microwave discharge light source apparatus according to claim 10, wherein said lamp supporting bar is supported by said cut-off pipe provided in said bottom plate by means of springs.

22. The microwave discharge light source apparatus according to claim 10, wherein said lamp supporting bar is supported by said cut-off pipe formed in said bottom plate by means of an adhesive.

23. The microwave discharge light source apparatus according to claim 10, wherein a recess is formed in said bottom plate, a coil spring is received in said recess with its one end fixed to said recess and said coil spring is engaged with a threaded portion formed in said lamp supporting bar.

24. The microwave discharge light source apparatus according to claim 10, wherein said lamp supporting bar is supported by said bottom plate through a flange member having an insertion hole for the supporting bar.

25. The microwave discharge light source apparatus according to any one of claims 10 or 20 through 24, wherein said lamp supporting bar is a part of a discharge pipe which is used for manufacturing said lamp.

26. The microwave discharge light source apparatus according to claim 18, wherein said surrounding member for surrounding said light transmitting member is a one piece body formed by plating or vapour deposition of metal in a mesh form on a light transmitting substance of plastics or glass.

27. The microwave discharge light source apparatus according to claim 18 wherein said surrounding member for surrounding said light transmitting member has a one piece body formed by embedding a metallic mesh in a light transmitting substance of plastics or glass.

28. The microwave discharge light source apparatus according to claim 23, wherein said threaded portion is constituted by a threaded body of metal which is fitted to said lamp supporting bar.

29. The microwave discharge light source apparatus according to claim 24, wherein said lamp supporting bar is detachably fitted to said flange member.

30. The microwave discharge light source apparatus according to claim 24 or 29, wherein said flange member is made of a dielectric substance.

31. The microwave discharge light source apparatus according to claim 29, wherein the top end of said lamp supporting bar is covered by an elastic material and the top end is inserted into said flange member to be supported.

32. The microwave discharge light source apparatus comprising:

a source of microwaves;

a waveguide connected to said source of microwaves;

a microwave resonance cavity, connected to said waveguide through a power feeding port;

a lamp, said lamp being illuminated by discharge owing to an electromagnetic field of microwaves produced in said resonance cavity;

a hollow supporting bar projecting from a wall of said lamp and containing a rare gas and mercury to improve the starting operation.

33. The microwave discharge light source apparatus according to claim 32, wherein said hollow supporting bar functions as a supporting member of said lamp.

34. The microwave discharge light source apparatus according to claim 32, wherein said hollow supporting bar projects toward said power feeding port of said microwave cavity.

35. The microwave discharge light source apparatus according to claim 32, wherein said mercury is filled in said hollow supporting bar at a pressure below a saturated vapour pressure and a room temperature.

36. The microwave discharge light source apparatus according to claim 2, wherein said first element is in a cylindrical form.

37. The microwave discharge light source apparatus according to claim 2, wherein said first element is in a rectangular column form.

38. The microwave discharge light source apparatus according to claim 2, 36 or 37, wherein said first element is directly connected to said second element by welding.

39. The microwave discharge light source apparatus according to claim 2, 36 or 37, wherein said first element is connected to said second element by brazing.

40. The microwave discharge light source apparatus according to claim 36 or 37, wherein said reinforcing member is provided along the boundary of the first and second elements of said light transmitting member.

41. The microwave discharge light source apparatus according to claim 36 or 37, wherein said reinforcing member is provided along the axial line of said first element in a cylindrical form of said light transmitting member.

42. The microwave discharge light source apparatus according to claim 36 or 37, wherein there are two reinforcing members and said reinforcing members are provided along said first element and along the boundary of said first and second elements of said light transmitting member.

43. The microwave discharge light source apparatus according to claim 36 or 37, wherein coefficient of thermal expansion of said reinforcing member is substantially equal to that of said microwave resonance cavity in a case that said reinforcing member is jointed to said microwave resonance cavity.

44. The microwave discharge light source apparatus according to claim 36 or 37, wherein said reinforcing member surrounds said light transmitting member.

45. A microwave discharge light source apparatus comprising a microwave resonance cavity having a wall surface, a substantial part of which is constituted by a light transmitting member, said microwave resonance cavity receiving microwaves from a waveguide through a power feeding port, a lamp placed in said microwave resonance cavity at such a position that the three-dimensional angle from a point in said lamp which includes the entire light transmitting member is at least $2\pi$ steradian characterized in that said light transmitting member is formed by a mesh member having a conductive surface and wires crossed each other to form said mesh member are electrically jointed integrally and without any contact resistance at each crossing point, said microwave resonance cavity being provided at the other side with a light reflecting plate for reflecting light emitted from said microwave resonance cavity.

46. The microwave discharge light source apparatus according to claim 45, wherein said light reflecting plate is secured to said microwave cavity wall in one piece.

47. The microwave discharge light source apparatus according to claim 38, wherein said first and second elements are jointed through an annular member placed along the inner circumferential part of one open end of said first element.

48. The microwave discharge light source apparatus according to claim 38, wherein said first and second elements are jointed through an annular member placed along the outer circumferential part of one open end of said first element.

49. The microwave discharge light source apparatus according to claim 42, wherein said reinforcing members provided along the first element and along the boundary of said first and second elements are mechanically jointed each other.

* * * * *